United States Patent [19]

Pfeil et al.

[11] 3,994,787

[45] Nov. 30, 1976

[54] PROCESS FOR PRODUCING AND OPERATING AN ELECTROPLATING BATH

[75] Inventors: Emanuel Pfeil, Marburg-Ockershausen; Klaus Röschmann, Schulp, Nortorf, both of Germany

[73] Assignee: Teldec Telefunken-Decca Schallplatten GmbH, Hamburg, Germany

[22] Filed: Sept. 23, 1975

[21] Appl. No.: 616,037

[30] Foreign Application Priority Data

Sept. 25, 1974 Germany ..... 2445708

[52] U.S. Cl. ..... 204/49; 204/45 R; 204/DIG. 13; 210/42 R; 423/143; 423/387

[51] Int. Cl.[2] ..... C25D 3/12; C02B 1/18

[58] Field of Search ..... 210/42, 59; 423/143, 423/385, 397, 387; 204/DIG. 13, 45 R–55 R, 43–44

[56] References Cited

OTHER PUBLICATIONS

Chemical Abstracts, 43332x, p. 495, vol. 70, (1969).

*Primary Examiner*—G. L. Kaplan

*Attorney, Agent, or Firm*—Spencer & Kaye

[57] ABSTRACT

A process for producing and operating an electroplating bath in which there appears $NH_4^+$ ions which impair the quality of the bath comprising adding salts of a hexanitrocobaltate-III complex to the bath to bring about precipitation of the $NH_4^+$ ions.

16 Claims, No Drawings

PROCESS FOR PRODUCING AND OPERATING AN ELECTROPLATING BATH

BACKGROUND OF THE INVENTION

The invention relates to a method for producing and operating an electroplating bath. Such baths are used, for example, for manufacturing masters or matrices used in the manufacture of phonographic discs.

One difficult problem which arises during the operation of various types of electroplating baths is that the electro-deposited metal is deposited from the bath in a relatively hard, that is, brittle, condition and in a state of high tensile stress, and in such a state the electrodeposited metal has a tendency to crack or peel away from the basic metal on which it is deposited. Generally, each electroplating bath must be operated and maintained within prescribed limits for the particular bath being used, and the above problem is particularly apparent when one or more recommended tolerance conditions for the bath are exceeded, for example, if certain temperature and pH values are not maintained. Other factors which are known to affect stress are current density, solution composition and contaminants. During operation of the bath, the conditions of the bath generally change, and the result of the changes is that the quality of the bath generally is impaired and the bath has to be discarded. Electroplating baths containing sulfamate ions, such as those used for electrodepositing nickel, are particularly susceptible to changing conditions and give rise to tension stressed electrodeposits.

SUMMARY OF THE INVENTION

It is a primary object of the present invention to provide a process which avoids compromising the quality of electroplating baths.

It is another object of the present invention to provide a process for regenerating an electroplating bath whose quality has been impaired.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

The present invention is based on the recognition that the high tensile stress deposits produced by electroplating baths are caused by the formation of $NH_4^+$ ions in the bath due to hydrolysis of the sulfamate ion in accordance with the equation:

$$H_2N{-}SO_3^- + H_2O \rightarrow NH_4^+ + SO_4^{=} \qquad 1.$$

Thus, it has been found that small quantities of ammonium ions which are formed in the bath interfere with the electrolytic deposition of metals and adversely change their characteristics, so that an increase of the $NH_4^+$ ion concentration in the bath to as little as 1 g/l is undesirable.

With this in mind, and in accordance with the present invention, the $NH_4^+$ ions are removed quantatively from electroplating sulfamate ion containing baths. In accordance with the present invention, the $NH_4^+$ ions are removed from the bath by ading hexanitrocobaltate-III-salts to the bath to bring about precipitation of the $NH_4^+$ ions.

Experiments conducted in accordance with the present invention have shown that ammonium ions can be removed quantitatively from electroplating baths by precipitation by means of the hexanitrocobaltate-III-complexes $(Co\text{-}(NO_2)_6)^{-3}$ to form difficulty or non-soluble ammonium hexanitrocobaltate complexes. This result was unexpected, because the sulfamate ion can, depending on the pH values of the bath, react quickly and easily with the nitrite ion which is in the hexanitrocobaltate-III complex. The fact that the $NH_4^+$ can, nonetheless, be precipitated is due to the fact that the rate of reaction with respect to the formation of the non-soluble ammonium hexanitrocobaltate complex is greater than the pH-dependent decomposition of the hexanitrocobaltate anions.

It is to be understood that both the foregoing general description and the following detailed description are exemplary, but are not restrictive of the invention.

DETAILED DESCRIPTION OF THE INVENTION

In the practice of the present invention, a salt of hexanitrocobaltate-III is added to the electroplating bath. In selecting the hexanitrocobaltate salt, particular attention should be given to the cations associated with the hexanitrocobaltate complex. One salt that can be used is a sodium salt hexanitrocobaltate. If a sodium salt is used, the sodium will appear in the bath, in an equivalent quantity, and replace the ammonium ions. In certain applications, it is not desired to have sodium present in the bath and another cation is then used. Preferably, those cations are used which do not adversely affect the quality of the bath. For example, nickel hexanitrocobaltate is a particularly suited salt for use in the present invention. In addition, zinc or magnesium hexanitrocobaltate can be used in the present invention. Further, it is particularly advantageous to use a cation which is able to combine with the sulfate ions formed in accordance with equation (1) to form compounds which are difficultly soluble. For example, the cation of the hexanitrocobaltate salt can be $Ca^{+2}$, $Sr^{+2}$, $Ba^{+2}$ or $Pb^{+2}$. By using cations having a valence state of +2, and which form a difficulty soluble salt with sulfate ions, half of the quantity of sulfate ions, which is equivalent to the ammonium content, is removed from the bath by precipitation. Both of the resulting hexanitrocobaltate and sulfate precipitates can, if desired, possibly after the complete bonding and precipitation of the remainder of the $SO_4^{--}$ ions, be filtered off or be centrifuged from the bath. Remaining $SO_4^{--}$ ions can be removed by $BaCO_3$. Suitable cations for the hexanitrocobaltate are all such ions of metals that give salts more soluble than hexanitrocobaltate of ammonium, e.g. $Na^+$, $K^+$, $CA^{++}$, $Sr^{++}$, $Ba^{++}$, $Mg^{++}$, $Pb^{++}$, $Zn^{++}$, $Ni^{++}$, $Cu^{++}$, $Co^{++}$ or mixtures thereof.

The hexanitrocobaltate precipitating reagent can be introduced into the bath in solid form or as a solution. Moreover, the hexanitrocobaltate precipitating reagent can be produced in situ in the bath by adding to the bath compounds which form the hexanitrocobaltate-III complex. For example, a cobalt salt and a nitrite salt can be added to the bath. Suitable cobalt salts and nitrite salts that can be used in form the hexanitrocobaltate complex are for example $CoCl_2$, $Co\ (NO_3)_2$, $CoSO_4$ and $NaNO_2$ or $Ba\ (NO_2)_2$.

The amount of hexanitrocobaltate salt added to the electroplating bath should be sufficient to bring about a quantitative precipitation of the $NH_4^+$ ions formed in the bath and thus an equivalant amount, and preferably an excess amount, of hexanitrocobaltate salt is added to the bath. The electroplating baths generally have a high salt concentration, and this high salt concentration favors the precipitation of ammonium hexanitrocobaltate so that usually a small excess of hexanitrocobaltate precipitating reagent is sufficient to bring about the precipitation. For example, an excess of 1%–0.01 % hexanitrocobaltate salt can be used. Generally, the working pH of the electroplating bath is adjusted, for example, by addition of an acid to the bath, after the formation and removal of the hexanitrocobaltate precipitates, and during this adjustment, the excess hexanitrocobaltate is transformed into cobalt (II) ions with the development of nitrogen.

The removal and precipitation of the undesired ammonium ion can be improved through the formation of double salts by adding to the bath cations which likewise form difficultly soluble salts with hexanitrocobaltate so that a hexanitrocobaltate double salt with ammonium ions and the further cations are formed. Preferably, the cations added are those which by themselves form a hexanitrocobaltate salt that is more difficulty soluble than ammonium hexanitrocobaltate. Particularly suitable cations for forming the double salt are $Li^+$, $K^+$, $Rb^+$ and $Cs^+$, and these cations are preferably introduced into the bath in the form of a soluble salt. These soluble salts preferably are added after the addition of the hexanitrocobaltate salt to the bath and the precipitation resulting therefrom. When forming double salts, an excess amount of hexanitrocobaltate precipitating agent is added to the bath.

The amount of the cations forming the double salts must match with the amount of $NH_4^+$ ions present.

The process of precipitating $NH_4^+$ ions can be used also with electroplating solutions, containing sulfate ions, chloride ions, $BF_4$-ions, pyrophosphates and other electroplating solutions. The process is unlimited concerning the cations that are deposited by the electroplating process.

The following examples are given by way of illustration to further explain the principles of the invention. These examples are merely illustrative and are not to be understood as limiting the scope and underlying principles of the invention in any way. All percentages referred to herein are by weight unless otherwise indicated.

The following examples illustrate the preipitation of undesired $NH_4^+$ ions from an electroplating bath.

EXAMPLE 1

The pH value of a nickel-sulfamate bath whose $NH_4^+$ concentration has increased to an undesired level is brought to a level of between 4.5 and 6.5 by addition of nickel carbonate to the bath. There is then added to the bath sodium hexanitrocobaltate. The amount of sodium hexanitrocobaltate added to the bath is calculataed from the ammonium ion content of the bath. Upon addition of the sodium hexanitrocobaltate, a precipitate forms and this precipitate is filtered out. After filtering, the bath is then brought to the working pH of by adding sulfamic acid. A nickel master is made in a bath which has thus been regenerated in accordance with the present invention, and the resulting master has a nickel plate formed from low-tension and ductile deposits. A bath for electroplating may be prepared according to the following formula 450 g/l nickel-sulfamate
5 g/l nickel-chloride 40 g/l boric acid The bath is preferably operated at a temperature of from 50° to 60° C. The working pH is adjusted from 4.0 to 4.5.

EXAMPLE 2

A sulfamate-nickel bath having an undesired $NH_4^+$ concentration is adjusted to a pH value of between 4.5 and 6.5. Sodium hexanitrocobaltate is then added in an amount to bring about an excess of 1% of the sodium hexanitrocobaltate. Upon addition of the sodium hexanitrocobaltate, an ammonium hexanitrocobaltate salt precipitate forms and one then proceeds as in Example 1.

EXAMPLE 3

To a sulfamate bath as in Example 2, a potassium salt is added after the addition if the sodium hexanitrocobaltate and resulting precipitation of the ammonium salt. To equivalent quantity of this potassium salt should be equal to approximately half of the amount of hexanitrocobaltate reagent used as excess. For example, if an excess of 2 g/l sodium hexanitrocobaltate is used, 0.15 to 0.25 g/l potassium ions, in the form of a soluble salt, is added. The required amount of K ions is not critical, but it is advisably such that the hexanitrocobaltate ions to potassium ions are in an equivalent ratio of 2:1. Upon addition of the potassium salt, a second precipitate is formed which is a double salt of hexanitrocobaltate with ammonium and potassium. The two precipitates are filtered from the bath.

The working pH value of the bath is then adjusted by adding sulfamic acid as in Example 1.

The potassium salt was potassium-sulfamate, the second precipitate must not be separated from the first precipitate.

EXAMPLE 4

The procedure of Example 3 is repeated, except that the amount of excess precipitating reagent is so selected that after the precipitation of both the ammonium salt and the ammonium double salt, 0.05 g/l of the hexanitrocobaltate reagent still remains in solution. In this way, remaining residual amounts of ammonium are avoided, which amounts are due to unavoidable inaccuracies in the analysis data.

EXAMPLE 5

The procedures of Examples 1 to 4 are repeated, except that calcium hexanitrocobaltate is used as the precipitating reagent. Here, part of the sulfate ions formed in accordance with equation (1) goes along in the precipitate.

EXAMPLE 6

The procedures of Examples 1 to 4 are repeated, except that the precipitating reagent is strontium hexanitrocobaltate. Part of the sulfate ions formed in accordance with equation (1) goes along in the precipitate.

EXAMPLE 7

The procedures of Examples 1 to 4 are repeated, except that the precipitating reagent is barium hexanitrocobaltate. Part of the sulfate ions formed in accordance with equation (1) goes along in the precipitate.

EXAMPLE 8

The procedures of Examples 1 to 4 are repeated, except that the precipitating reagent is lead hexanitrocobaltate. Part of the sulfate ions formed in accordance with equation (1) goes along in the precipitate.

EXAMPLE 9

The procedures of Examples 1 to 4 are repeated, except that the precipitating reagent is nickel hexanitrocobaltate.

EXAMPLE 10

A nickel-sulfamate bath whose pH value is adjusted to between 4.5 and 6.5 has added to it a cobalt salt and nitrite. By letting the bath stand, or by blowing air through the bath, hexanitrocobaltate is formed. The cobalt salt and nitrite are added in such concentration that the thus-obtained hexanitrocobaltate suffices for the precipitation of the ammonium ions in accordance with a process carried out as per one of the foreqoing examples. The cation of the nitrite can be the counter ion to the hexanitrocobaltate complex mentioned in the examples, as, for example, the Ni ions, Ca ions or others. After precipitation and removal of the precipitate, the bath is brought to a lower pH value by adding a small amount of acid. The cobalt salt added was cobalt-sulfamate and the nitrite salt was sodium-nitrite.

It will be understood that the above description of the present invention is susceptible to various modifications, changes and adaptations, and the same are intended to be comprehended within the meaning and range of equivalents of the appended claims.

What is claimed is:

1. A process for producing and operating an electroplating bath in which there appears $NH_4^+$ ions which impair the quality of the bath, comprising adding a salt of a hexanitrocobaltate-III-complex to the bath to bring about precipitation of the $NH_4^+$ ions.

2. Process according to claim 2, wherein the $NH_4^+$ ion is precipitated as a double salt with another ion which itself forms a salt that is more difficulty soluble than ammonium hexanitrocobaltate.

3. The process according to claim 2, wherein the precipitation is carried out with an excess of hexanitrocobaltate salt.

4. Process according to claim 1, wherein the precipitation is carried out with equivalent quantities of hexanitrocobaltate salt.

5. Process according to claim 1, wherein the precipitation is carried out with an excess of hexanitrocobaltate salt.

6. Process according to claim 1, wherein the cation which is introduced by the hexanitrocobaltate sait is $Ca^{+2}$, $Sr^{+2}$, $Ba^{+2}$ or $Pb^{+2}$.

7. Process according to claim 1 wherein the cation which is introduced by the hexanitrocobaltate salt is $Ni^{+2}$, $Zn^{+2}$or $Mg^{+2}$.

8. Process according to claim 1, and further comprising forming the hexanitrocobaltate in situ in the electroplating bath.

9. Process for producing and operating a nickel electroplating bath containing sulfamate ion in which there appears $NH_4^+$ ions which impair the quality of the bath, comprising adding a salt of a hexanitrocobaltate-III-complex to the bath to bring about precipitation of the $NH_4^+$ ions.

10. Process according to claim 9, wherein the $NH_4^+$ ion is precipitated as a double salt with another ion which itself forms a salt that is more difficultly soluble than ammonium hexanitrocobaltate.

11. Process according to claim 10, wherein the precipitation is carried out with an excess of hexanitrocobaltate salt.

12. Process according to claim 9, wherein the precipitation is carried out with equivalent quantities of hexanitrocobaltate salt.

13. Process according to claim 9, wherein the precipitation is carried out with an excess of hexanitrocobaltate salt.

14. Process accordingly to claim 9, wherein the cation which is introduced by the hexanitrocobaltate salt is $Ca^{+2}$, $Sr^{+2}$, $Ba^{+2}$ or $Pb^{+2}$.

15. Process according to claim 9 wherein the cation which is introduced by the hexanitrocobaltate salt is $Ni^{+2}$, $Zn^{+2}$, or $Mg^{+2}$.

16. Process according to claim 9, and further comprising forming the hexanitrocobaltate in situ in the electroplating bath.

* * * * *